US006644789B1

(12) United States Patent
Toews, III

(10) Patent No.: US 6,644,789 B1
(45) Date of Patent: Nov. 11, 2003

(54) NOZZLE ASSEMBLY FOR AN INK JET PRINTER

(75) Inventor: Herbert Gordon Toews, III, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/611,410

(22) Filed: Jul. 6, 2000

(51) Int. Cl.[7] ..... B41J 2/05
(52) U.S. Cl. ..... 347/63; 347/65
(58) Field of Search ..... 347/63, 67, 56, 347/44, 20, 47, 65

(56) References Cited

U.S. PATENT DOCUMENTS

| | | | | | |
|---|---|---|---|---|---|
| 4,059,480 | A | | 11/1977 | Ruh et al. | 438/701 |
| 4,246,076 | A | | 1/1981 | Gardner | 205/73 |
| 4,312,009 | A | | 1/1982 | Lange | 347/51 |
| 4,480,259 | A | * | 10/1984 | Kruger et al. | 347/63 |
| 4,528,070 | A | | 7/1985 | Gamblin | 101/128.4 |
| 4,727,012 | A | | 2/1988 | Quella et al. | 430/320 |
| 4,770,740 | A | | 9/1988 | Tsuzuki et al. | 216/27 |
| 4,789,425 | A | | 12/1988 | Drake et al. | 216/27 |
| 5,016,024 | A | | 5/1991 | Lam et al. | 347/63 |
| 5,057,853 | A | | 10/1991 | Fisher | 347/63 |
| 5,068,006 | A | | 11/1991 | Fisher | 216/27 |
| 5,229,785 | A | | 7/1993 | Leban | 347/47 |
| 5,305,018 | A | | 4/1994 | Schantz et al. | 347/47 |
| 5,334,999 | A | | 8/1994 | Kashiwazaki et al. | 347/65 |
| 5,350,616 | A | | 9/1994 | Pan et al. | 428/131 |
| 5,443,713 | A | | 8/1995 | Hindman | 205/70 |
| 5,524,784 | A | | 6/1996 | Shiba et al. | 216/27 |
| 5,560,837 | A | | 10/1996 | Trueba | 216/27 |
| 5,686,224 | A | | 11/1997 | O'Neill | 430/320 |
| 5,718,044 | A | * | 2/1998 | Baughman et al. | 347/63 |
| 5,738,799 | A | | 4/1998 | Hawkins et al. | 216/27 |
| 5,763,141 | A | | 6/1998 | Shimomura et al. | 430/320 |
| 5,766,441 | A | | 6/1998 | Arndt et al. | 205/170 |
| 5,820,771 | A | | 10/1998 | Burke et al. | 216/27 |
| 5,821,959 | A | | 10/1998 | Murakami et al. | 347/47 |
| 5,900,892 | A | | 5/1999 | Mantell et al. | 347/45 |
| 5,915,763 | A | | 6/1999 | Masuda | 29/890.1 |
| 6,000,787 | A | * | 12/1999 | Weber et al. | 347/65 |
| 6,270,201 | B1 | * | 8/2001 | Kasperchik et al. | 347/65 |
| 6,310,641 | B1 | * | 10/2001 | Mrvos et al. | 347/63 |

OTHER PUBLICATIONS

Madou, Marc. Fundamentals of Microfabrication. Washington, DC, CRC Press, 1997. pp. 6 and 7.*

* cited by examiner

*Primary Examiner*—Judy Nguyen
*Assistant Examiner*—Julian D. Huffman
(74) *Attorney, Agent, or Firm*—Taylor & Aust, P.C.

(57) ABSTRACT

An ink jet nozzle assembly includes a heater substrate and a nozzle plate. The nozzle plate includes a first resist layer having a first side laminated onto the heater substrate. The first resist layer includes an ink cavity and at least one heater chamber in fluid communication with the ink cavity. A support layer has a first side and a second side. The first side of the support layer is in contact with a second side of the first resist layer such that the support layer at least partially covers the ink cavity. A second resist layer has a side in contact with each of the second side of the first resist layer and the second side of the support layer. The second resist layer is supported by the support layer such that the second resist layer is retained substantially outside of the ink cavity. The second resist layer includes at least one nozzle hole. Each nozzle hole is substantially aligned with a corresponding heater chamber.

22 Claims, 3 Drawing Sheets

NOZZLE ASSEMBLY FOR AN INK JET PRINTER

BACKGROUND OF THE INVENTION

1. Field of the Invention

The present invention relates to ink jet printers, and, more particularly, to a nozzle assembly for an ink jet printer.

2. Description of the Related Art

An ink jet printer emits droplets of ink through the nozzles of a printhead and onto a print medium. The nozzles are formed in a nozzle plate that is laminated onto a heater chip to form a nozzle assembly. Resistive heaters within the heater chip heat the ink until the ink is vaporized and is thereby emitted through the nozzles.

Creation of a nozzle plate typically occurs in a process separate from the creation of the heater chip. The nozzle plate must then be aligned and adhered to the heater chip. The tolerances that build up during the fabrication, alignment and adhering of the nozzle plate limit the size and quantity of heaters and nozzles. Creating a nozzle plate on the heater chip itself improves the accuracy of the alignment between the nozzles and heaters to the level of the accuracy of the align/expose equipment.

It is known to create a structural member for ink flow channels and nozzles with two layers of imageable material. An ink cavity is formed in the first layer and nozzle holes are formed in the second layer. In a roof-shooter style ink jet printhead, the width of the ink cavity created in the first layer can be up to 500 microns. Because of the relatively large width of this span and the relative thinness of the second layer typically used, the second layer has a tendency to collapse into the ink cavity, thereby compromising the function of the nozzle plate.

What is needed in the art is a nozzle plate in which a relatively thin first layer of imageable material, which contains nozzle holes, is supported by a second layer that contains an ink cavity, such that the first layer does not collapse into the ink cavity of the second layer.

SUMMARY OF THE INVENTION

The present invention provides a nozzle plate formed from an imageable material sandwiched around a structural support mechanism.

The invention comprises, in one form thereof, an ink jet nozzle assembly including a heater substrate and a nozzle plate. The nozzle plate includes a first resist layer having a first side laminated onto the heater substrate. The first resist layer includes an ink cavity and at least one heater chamber in fluid communication with the ink cavity. A support layer has a first side and a second side. The first side of the support layer is in contact with a second side of the first resist layer such that the support layer at least partially covers the ink cavity. A second resist layer has a side in contact with each of the second side of the first resist layer and the second side of the support layer. The second resist layer is supported by the support layer such that the second resist layer is retained substantially outside of the ink cavity. The second resist layer includes at least one nozzle hole. Each nozzle hole is substantially aligned with a corresponding heater chamber.

An advantage of the present invention is that a relatively thin photoresist layer of the nozzle plate is able to successfully span the ink cavity without collapsing therein.

Another advantage is that the ink cavity can be easily cleaned out, resulting in fast throughput, less chemical usage, and tighter control on the ink cavity side wall definition.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

The present invention provides a nozzle plate formed with an imageable material on the die. The nozzle plate is structurally supported such that the nozzle plate can span the ink cavity without collapsing. More particularly, the nozzle plate has three-layers, wherein the first layer is an imageable material containing an ink cavity, the second layer acts as a structural support over the ink cavity, and the third layer is an imageable material supported by the second layer.

Figure 1:
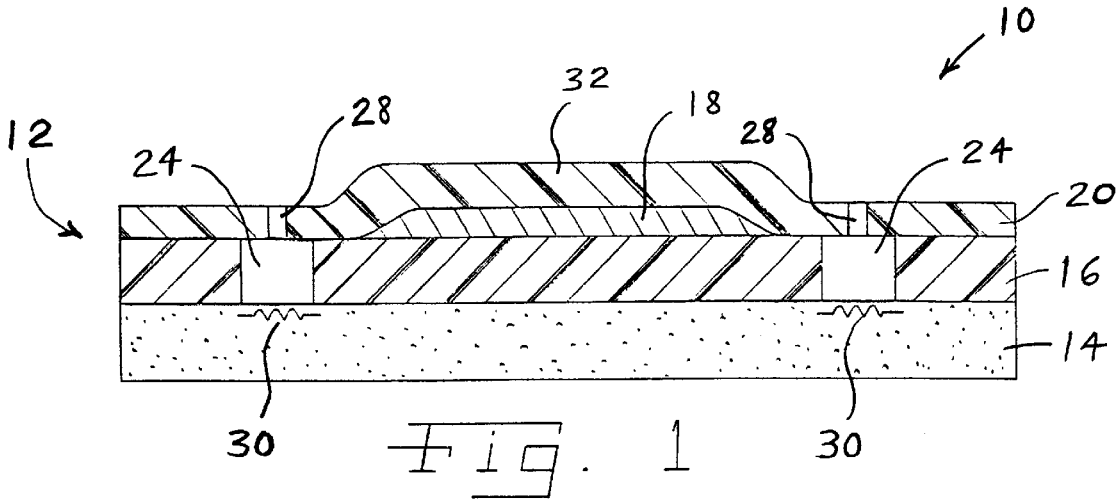
FIG. 1 is a side, sectional view of one embodiment of a nozzle assembly of the present invention.

Referring now to the drawings and particularly to FIG. 1, there is shown one embodiment of a nozzle assembly 10 of the present invention, including a nozzle plate 12 laminated onto a heater chip substrate 14. Nozzle plate 12 includes a first photoresist layer 16, a support structure 18 and a second photoresist layer 20.

Figure 2:
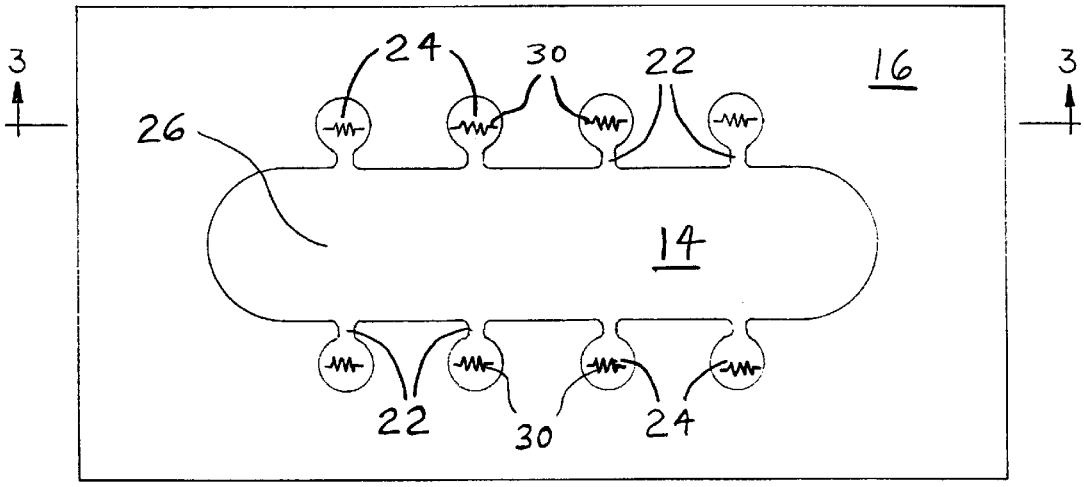
FIG. 2 is a top view of the first resist layer and heater chip substrate of FIG. 1.

First photoresist layer 16 is formed of an imageable material, such as a positive photoresist or a dry film, negative acting photoresist. Layer 16 includes ink channels 22 (FIG. 2) interconnecting heater chambers 24 with ink cavity 26.

Support structure 18 can be in the form of a layer of fiber material, mesh material, or a solid material. Support structure 18 is adhered to first layer 16 such that support layer 18 spans across ink cavity 26 in a direction perpendicular to the page of FIG. 1. Support layer 18 does not extend to the areas above heater chambers 24. The thickness of support layer 18 in the direction perpendicular to nozzle plate 12 is exaggerated in the drawings for clarity of illustration.

Second photoresist layer 20, like first photoresist layer 16, is formed of a flexible, imageable material, such as a positive photoresist or a dry film, negative acting photoresist. Second layer 20 includes nozzle holes 28, each aligned with a respective one of heater chambers 24 so as to provide fluid communication therebetween. Second layer 20, which is laminated to first layer 16 and support layer 18, is suspended above ink cavity 26 by support layer 18.

Substrate 14 includes resistive heater elements 30, each of which is aligned with a respective heater chamber 24 so as to heat and thereby vaporize ink in chambers 24. The vaporization of the ink causes the ink to be emitted from nozzle holes 28.

Figure 3:
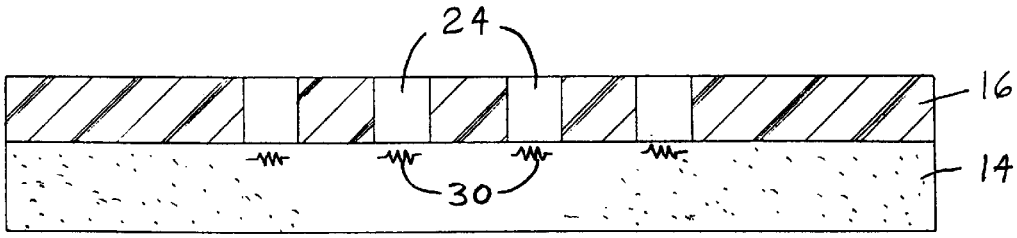
FIG. 3 is a front, sectional view of the first resist layer and heater chip substrate through line 3—3 of FIG. 2.

In a first step in forming nozzle plate 12 on wafer substrate 14, an imageable material in the form of dry film resist layer 16 is laminated onto substrate 14. The negative photoresist of first layer 16 is selectively exposed to light with a mask (not shown). The mask prevents the portion of first layer 16 that is to become ink cavity 26, ink channels 22 and heater chambers 24 from being exposed to the light. For example, the mask could be in the form of a sheet of glass with a pattern of chrome adhered to one side, with the chrome pattern corresponding to the desired placements of ink cavity 26, ink channels 22 and heater chambers 24. Developing removes the unexposed resist in ink cavity 26, ink channels 22 and heater chambers 24, resulting in the structure shown in FIGS. 2 and 3.

Nozzle assembly 10 uses a center fed ink delivery method to supply ink to ink cavity 26 through the via (not shown). The via can be created either prior to laminating first layer 16 to substrate 14, or after the creation of ink cavity 26, ink channels 22 and heater chambers 24.

Figure 4:
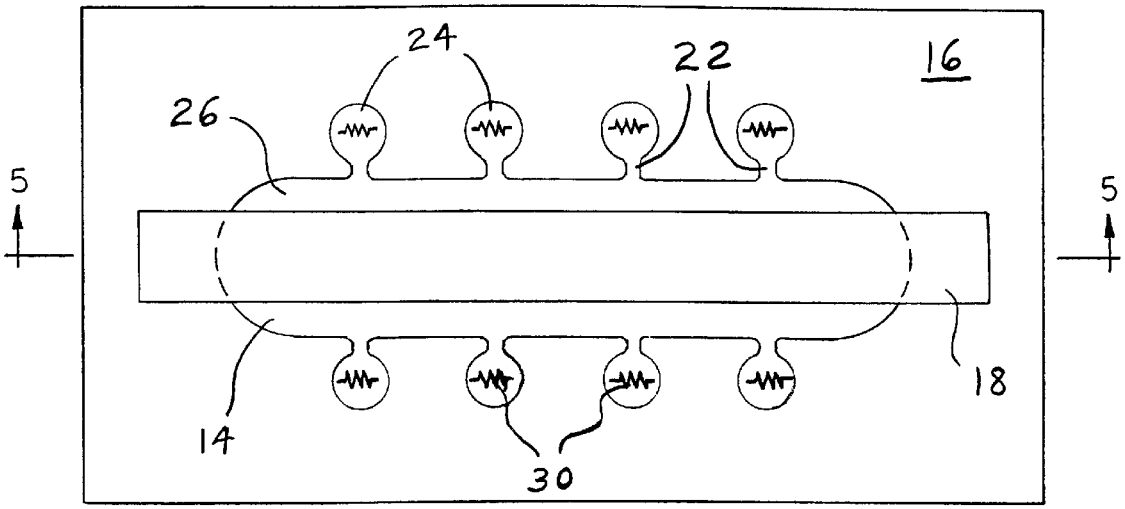
FIG. 4 is a top view of the support layer, first resist layer and heater chip substrate of FIG. 1.
Figure 5:
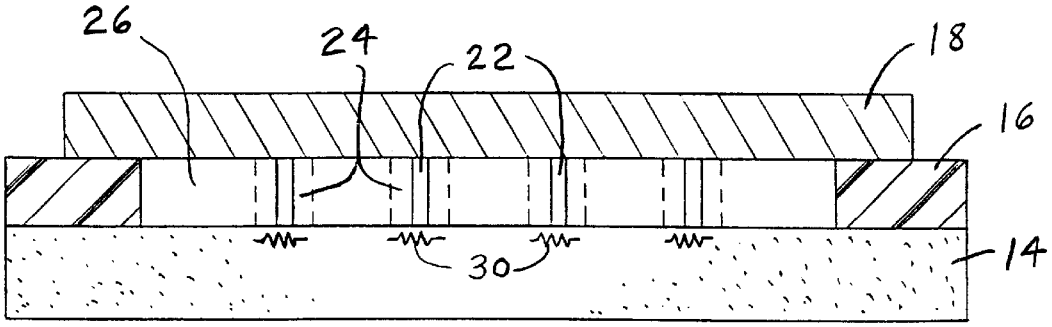
FIG. 5 is a front, sectional view of the support layer, first resist layer and heater chip substrate through line 5—5 of FIG. 4.

After the formation of ink cavity 26, ink channels 22 and heater chambers 24, support material 18 is applied above the ink via portion of ink cavity 26. The function of support material 18 is to provide structural support to second resist layer 20. Support layer 18 can span ink cavity 26 either in the lengthwise direction (shown in FIGS. 4 and 5) or the perpendicular direction. Adhering support material 18 to first layer 16 can be achieved either through heat or a separate adhesive.

Figure 6:
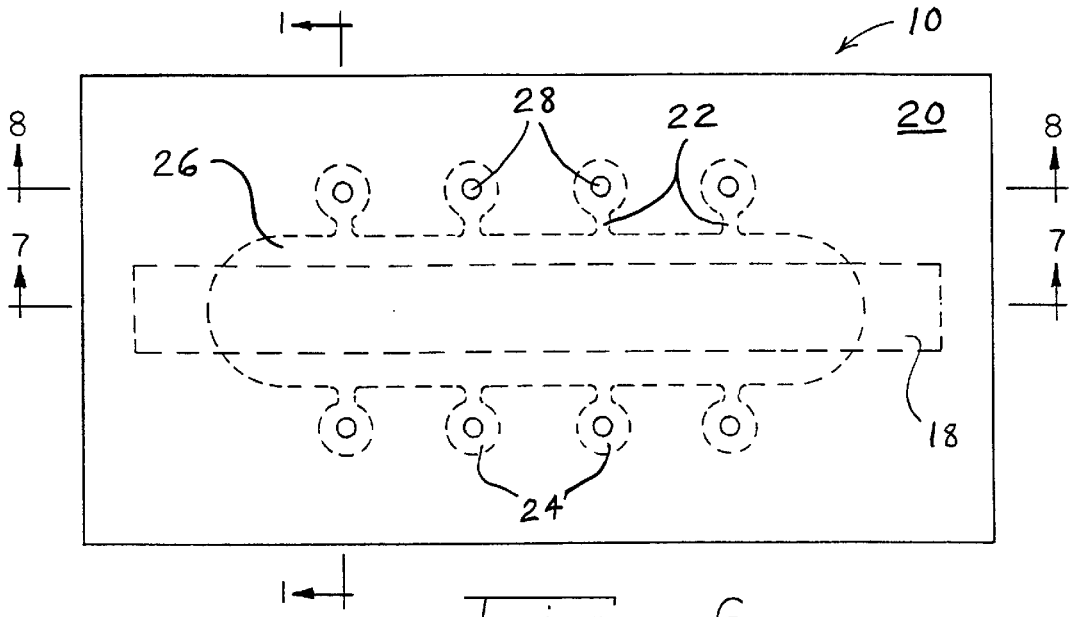
FIG. 6 is a top view of the nozzle assembly of FIG. 1.
Figure 7:
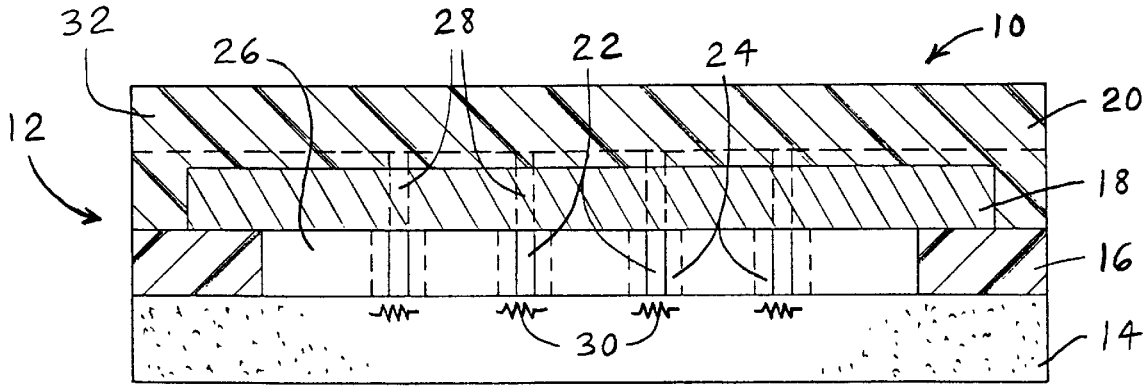
FIG. 7 is a front, sectional view of the nozzle assembly through line 7—7 of FIG. 6.
Figure 8:
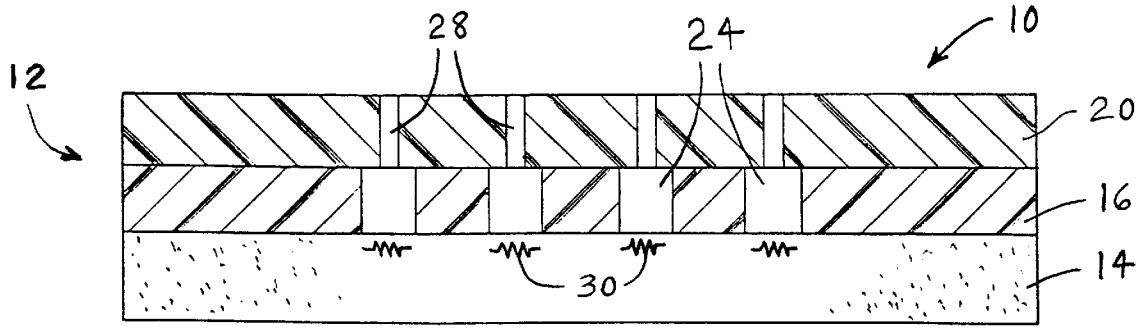
FIG. 8 is a front, sectional view of the nozzle assembly through line 8—8 of FIG. 6.

Second resist layer 20 of imageable material is laminated over first resist layer 16 and support layer 18. As is evident in FIG. 1, the thickness of support layer 18 can cause a middle portion 32 of second resist layer 20 to be slightly elevated from the portions of second resist layer 20 that directly contact first resist layer 16. Nozzle holes 28 are created in second resist layer 20 by exposure while masking nozzle holes 28 and then developing away the material in nozzle holes 28. The final structure is shown in FIGS. 6–8. Since support material 18 is present over the main portion of ink cavity 26 but does not cover heater chambers 24 and nozzle holes 28, support material 18 is not required to be photoimageable, transparent, or opaque.

The first resist layer 16 has been described herein as being a dry film resist layer. However, it is to be understood that the imageable material of layer 16 could also be of a liquid form which is applied with a spin coating process.

Support layer 18 has been shown herein as being in the form of a continuous layer of material. However, support layer 18 can also be formed a plurality of disconnected pieces. For example, elongate strands of support material can be laid side-by-side across ink cavity 26. The sides of adjacent ones of such strands may or may not be touching each other.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet nozzle assembly, comprising:

a heater substrate; and a nozzle plate, including:

a first resist layer having a first side laminated onto said heater substrate, said first resist layer including an ink cavity and at least one heater chamber in fluid communication with said ink cavity;

a support layer having a first side and a second side, said first side of said support layer being in contact with a second side of said first resist layer such that said support layer at least partially covers said ink cavity; and a second resist layer having a side in contact with each of said second side of said first resist layer and said second side of said support layer, said second resist layer being supported by said support layer such that said second resist layer is retained substantially outside of said ink cavity, said second resist layer including at least one nozzle hole, said nozzle hole being substantially aligned with a corresponding said heater chamber.

2. The nozzle assembly of claim 1, wherein said heater substrate includes at least one heater element, each said heater element being associated with a corresponding said heater chamber.

3. The nozzle assembly of claim 1, wherein said first resist layer comprises a first negative acting photoresist layer, said second resist layer comprising a second negative acting photoresist layer.

4. The nozzle assembly of claim 1, wherein said support layer comprises one of a fiber material, mesh material and solid material.

5. The nozzle assembly of claim 1, wherein said support layer comprises at least one elongate element spanning said ink cavity in at least one of a lengthwise direction and a direction perpendicular to said lengthwise direction.

6. The nozzle assembly of claim 1, wherein said first resist layer includes at least one ink channel, each said ink channel interconnecting said ink cavity with a corresponding said heater chamber.

7. An ink jet nozzle assembly, comprising:

a heater substrate; and a nozzle plate, including:

a first resist layer having a first side laminated onto said heater substrate, said first resist layer including an ink cavity and at least one heater chamber in fluid communication with said ink cavity;

a support layer having a first side and a second side, said first side of said support layer being in contact with a second side of said first resist layer such that said support layer at least partially covers said ink cavity; and a second resist layer having a side in contact with each of said second side of said first resist layer and said second side of said support layer, said second resist layer being supported by said support layer such that said second resist layer is retained substantially outside of said ink cavity, said second resist layer including at least one nozzle hole, said nozzle hole being substantially aligned with a corresponding said heater chamber;

wherein said support layer leaves said at least one heater chamber and said at least one nozzle hole uncovered.

8. An ink jet nozzle plate, comprising:

a first resist layer having a first side and a second side, said first resist layer including an ink cavity and at least one heater chamber in fluid communication with said ink cavity;

a support layer having a first side and a second side, said first side of said support layer being in contact with said second side of said first resist layer such that said support layer at least partially covers said ink cavity; and a second resist layer having a side in contact with each of said second side of said first resist layer and said second side of said support layer, said second resist layer being supported by said support layer such that said second resist layer is retained substantially outside of said ink cavity, said second resist layer including at least one nozzle hole, said nozzle hole being substantially aligned with a corresponding said heater chamber.

9. The nozzle plate of claim 8, wherein said first resist layer comprises a first negative acting photoresist layer, said second resist layer comprising a second negative acting photoresist layer.

10. The nozzle plate of claim 8, wherein said support layer comprises one of a fiber material, mesh material and solid material.

11. The nozzle plate of claim 8, wherein said support layer comprises at least one elongate element spanning said ink cavity in at least one of a lengthwise direction and a direction perpendicular to said lengthwise direction.

12. The nozzle plate of claim 8, wherein said first resist layer includes at least one ink channel, each said ink channel interconnecting said ink cavity with a corresponding said heater chamber.

13. An ink jet nozzle plate, comprising:

a first resist layer having a first side and a second side, said first resist layer including an ink cavity and at least one heater chamber in fluid communication with said ink cavity;

a support layer having a first side and a second side, said first side of said support layer being in contact with said second side of said first resist layer such that said support layer at least partially covers said ink cavity; and a second resist layer having a side in contact with each of said second side of said first resist layer and said second side of said support layer, said second resist layer being supported by said support layer such that said second resist layer is retained substantially outside of said ink cavity, said second resist layer including at least one nozzle hole, said nozzle hole being substantially aligned with a corresponding said heater chamber;

wherein said support layer leaves said at least one heater chamber and said at least one nozzle hole uncovered.

14. An ink jet nozzle plate, comprising:

a first imageable layer having a first side and a second side, said first imageable layer including an ink cavity and at least one heater chamber in fluid communication with said ink cavity;

a support structure having a first side and a second side, said first side of said support structure being in contact with said second side of said first imageable layer such that said support structure is at least partially covering said ink cavity; and a second imageable layer having a side in contact with each of said second side of said first imageable layer and said second side of said support structure, said second imageable layer being supported by said support structure such that said second imageable layer is retained substantially outside of said ink cavity, said second imageable layer including at least one nozzle hole, said nozzle hole being substantially aligned with a corresponding said heater chamber.

15. The nozzle plate of claim 14, wherein said first imageable layer comprises a first negative acting photoresist layer, said second imageable layer comprising a second negative acting photoresist layer.

16. The nozzle plate of claim 14, wherein said support structure comprises one of a fiber material, mesh material and solid material.

17. The nozzle plate of claim 14, wherein said support structure comprises at least one elongate element spanning said ink cavity in at least one of a lengthwise direction and a direction perpendicular to said lengthwise direction.

18. The nozzle plate of claim 14, wherein said first imageable layer includes at least one ink channel, each said ink channel interconnecting said ink cavity with a corresponding said heater chamber.

19. An ink jet nozzle plate, comprising:

a first layer having a first side and a second side, said first layer including an ink cavity and at least one heater chamber, said at least one heater chamber in fluid communication with said ink cavity;

a support structure having a first side and a second side, said first side of said support structure being in contact with said second side of said first layer such that said support structure at least partially covers said ink cavity; and a second layer supported by said support structure such that said second layer is retained substantially outside of said ink cavity, said second layer including at least one nozzle hole, said nozzle hole being substantially aligned with a corresponding said heater chamber;

wherein said support structure leaves said at least one heater chamber and said at least one nozzle hole uncovered.

20. A method of manufacturing an ink jet nozzle plate, comprising the steps of:

providing a first layer including an ink cavity and at least one heater chamber in fluid communication with said ink cavity;

adhering a support structure to said first layer, said support structure at least partially covering said ink cavity;

laminating a second layer to each of said first layer and said support structure such that said second layer is retained substantially outside of said ink cavity; and creating at least one nozzle hole in said second layer such that each said nozzle hole is substantially aligned with a corresponding said heater chamber.

21. The method of claim 20, wherein said support structure supports said second layer above said ink cavity of said first layer.

22. The method of claim 20, comprising the further step of laminating said first layer onto a substrate.

* * * * *